US008390460B2

(12) United States Patent
Zinner

(10) Patent No.: US 8,390,460 B2
(45) Date of Patent: Mar. 5, 2013

(54) SURVEILLANCE DEVICE

(75) Inventor: Ulrich Zinner, Philadelphia (ZA)

(73) Assignee: Bell-Oak Investment (Proprietary) Limited, Philadelphia (ZA)

( * ) Notice: Subject to any disclaimer, the term of this patent is extended or adjusted under 35 U.S.C. 154(b) by 713 days.

(21) Appl. No.: 12/520,429

(22) PCT Filed: Dec. 20, 2007

(86) PCT No.: PCT/IB2007/055253

§ 371 (c)(1),
(2), (4) Date: Nov. 2, 2009

(87) PCT Pub. No.: WO2008/075310

PCT Pub. Date: Jun. 26, 2008

(65) Prior Publication Data

US 2010/0060460 A1 Mar. 11, 2010

(30) Foreign Application Priority Data

Dec. 20, 2006 (ZA) ..... 2006/10730

(51) Int. Cl.
*G08B 13/14* (2006.01)

(52) U.S. Cl. ..... 340/572.9

(58) Field of Classification Search .... 340/572.1–572.9; 70/14, 19, 41

See application file for complete search history.

(56) References Cited

U.S. PATENT DOCUMENTS

| | | | | |
|---|---|---|---|---|
| 6,098,256 | A * | 8/2000 | Poussard | 24/704.1 |
| 6,226,839 | B1 * | 5/2001 | Sayegh | 24/16 PB |
| 6,326,890 | B1 * | 12/2001 | Costa | 340/572.9 |
| D506,694 | S | 6/2005 | Corney | |
| 7,259,674 | B2 * | 8/2007 | Marsilio et al. | 340/572.1 |
| 7,391,327 | B2 * | 6/2008 | Ho | 340/572.3 |
| 7,595,733 | B2 * | 9/2009 | Spagna | 340/572.8 |
| 7,650,768 | B2 * | 1/2010 | Fawcett et al. | 70/58 |
| 2006/0021394 | A1 | 2/2006 | Belden | |
| 2006/0170559 | A1 | 8/2006 | Marsilio et al. | |

FOREIGN PATENT DOCUMENTS

| | | |
|---|---|---|
| EP | 1074682 | 2/2001 |
| WO | WO-9623123 A1 | 8/1996 |
| WO | WO-03093614 A1 | 11/2003 |

OTHER PUBLICATIONS

Supplementary European Search Report, Application No. EP 07859477, Sep. 7, 2011.

* cited by examiner

*Primary Examiner* — Phung Nguyen
(74) *Attorney, Agent, or Firm* — Novak Druce Connolly Bove + Quigg LLP

(57) ABSTRACT

A surveillance tag (10) is provided that has a body (12) defining an inner cavity (16) with one or more marker (18,52) and one or more detent (30) housed inside the cavity (16). The tag (10) includes a latch (20) that is pivotally attached to the body (12) and that defines one or more locking formations (26) that is spaced from its pivotal attachment to the body (12). The latch (20) is configured to pivot between a dosed orientation in which it's locking formation (26) is proximate the body (12) and an open condition in which the locking formation (26) is free from the body (12). The detent (30) is configured to engage the locking formation (26) of the latch (20) when the latch (20) is in its closed orientation and can be released by being attracting it with a magnetic force towards a detacher outside the body (12).

14 Claims, 5 Drawing Sheets

SURVEILLANCE DEVICE

CROSS REFERENCE TO RELATED APPLICATIONS

This application is a national phase of PCT/IB2007/055253, filed on Dec. 20, 2007, which claims priority to South African application 2006-10730, filed on Dec. 20, 2006, the entire contents of which are incorporated herein by reference in their entireties.

FIELD OF THE INVENTION

This invention relates to electronic article surveillance (EAS) security devices or security tags that can be applied to articles such as merchandise to inhibit theft or pilfering. In particular, the invention relates to re-usable EAS tags suitable for surveillance bottles.

BACKGROUND TO THE INVENTION

Security devices in the form of tags that can be attached to merchandise in EAS systems are widely used to alert retailers to unauthorised removal of tagged merchandise from the premises. The tags can be disposable or re-usable and a re-usable tag typically includes a body housing an EAS marker (also known in the art as a "sensor"). The body can be attached to the merchandise it is intended to protect and this is typically done with the aid of a tack with a shank that can pass through an article of merchandise and that can be received in an aperture in the tag body, where it is held firmly to prevent removal of the tag from the article of merchandise.

Some articles, especially valuable articles, are more susceptible or shoplifting than others and the geometry of some articles makes it difficult to attach a security tag to such an article. Bottled beverages, especially expensive alcoholic beverages are particularly susceptible to shoplifting and security tags have been developed that can be attached to such bottles. A security tag of this type typically includes a body housing the marker and a flexible, elongate tensile element that is attached to the housing at one end and that can extend around the neck of the bottle.

Security tags for bottled merchandise of this type have a number of disadvantages in that the need for the tensile members to be flexible either requires them to be made from expensive, durable materials, or causes them to be too weak, thus allowing easy unauthorised removal of the tags from bottles. Further, the free ends of the tensile elements protrude from the tags in a way that is unsightly and cumbersome.

The present invention seeks to provide a re-usable surveillance device that can be applied to articles such bottles and that are secure, cost effective and compact. The invention further seeks to provide such a surveillance device that can house multiple sensors, preferably different types of sensors.

SUMMARY OF THE INVENTION

According to the present invention there is provided a surveillance device which includes:

a body defining an inner cavity;

at lease one marker housed within the cavity;

at least one detent housed within the body; and a latch that is pivotally attached to the body and that defines at least one locking formation that is spaced from its pivotal attachment to the body, the latch being configured to pivot between a closed orientation in which its looking formation is proximate the body and an open condition in which the locking formation is free from the body, and the detent being configured to engage the locking formation of the latch when the latch is in its closed orientation.

The phrase "proximate the body" refers in this specification to positions inside and/or outside the body.

The latch and/or the body may define a neck recess through which the neck of a bottle can extend when the latch is closed. E.g. the latch may be curved around its neck recess.

The locking formation may be a locking recess and the detent may engage the locking recess by being received in the recess, at least in part.

The device may include at least one bias element, configured to urge the detent towards the locking recess, when the latch is in its closed orientation and the bias element may be a spring, an elastomeric compressible element, or the like.

The device may include a release mechanism, configured to withdraw the detent from the locking recess, e.g. the detent may be configured to be attracted against the bias, by a magnet outside the body.

The latch may define a plurality of locking recesses in which the detent is receivable and the detent may be receivable in the locking recesses in ratchet fashion.

The marker may be a radio frequency (RF) marker, an acousto magnetic (AM) marker, or an electro magnetic (EM) marker. However, in a preferred embodiment, the device includes a plurality of different markers, to allow it to be used as a multiple sensor surveillance tag. Further, the device preferably includes an acousto magnetic (AM) marker and a permanent magnet configured to provide a magnetic field for operation of the AM marker.

The device may include at least two detents that are spaced apart and that may be configured to engage locking formations of the latch in respective non-parallel directions.

BRIEF DESCRIPTION OF THE DRAWINGS

For a better understanding of the present invention, and to show how the same may be carried into effect, reference will now be made, by way of nor limiting example, to the accompanying drawings in which.

DETAILED DESCRIPTION OF THE DRAWINGS

Figure 1:
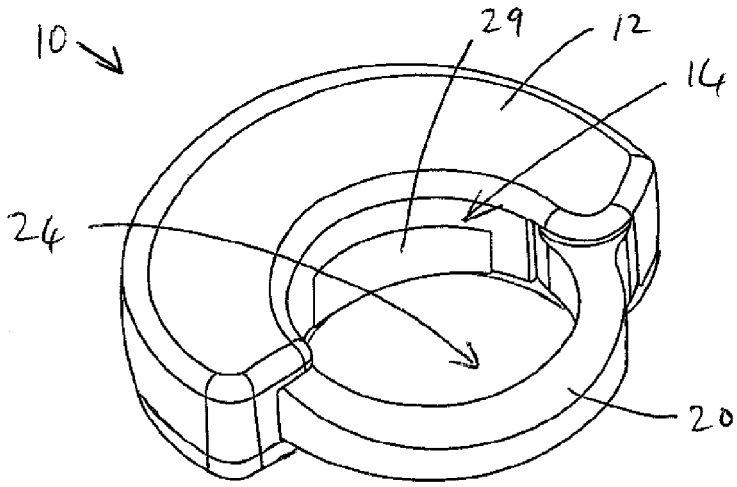
FIG. 1 is a three dimensional view of a surveillance device in accordance with a first embodiment of the present invention.

Referring to the drawings, a surveillance device in the form of an EAS tag in accordance with the present invention is generally indicated by reference numeral 10. The same reference numerals have been used to refer to the same functional features in different embodiments of the invention, even though the functional features may differ between embodiments.

Figure 2:
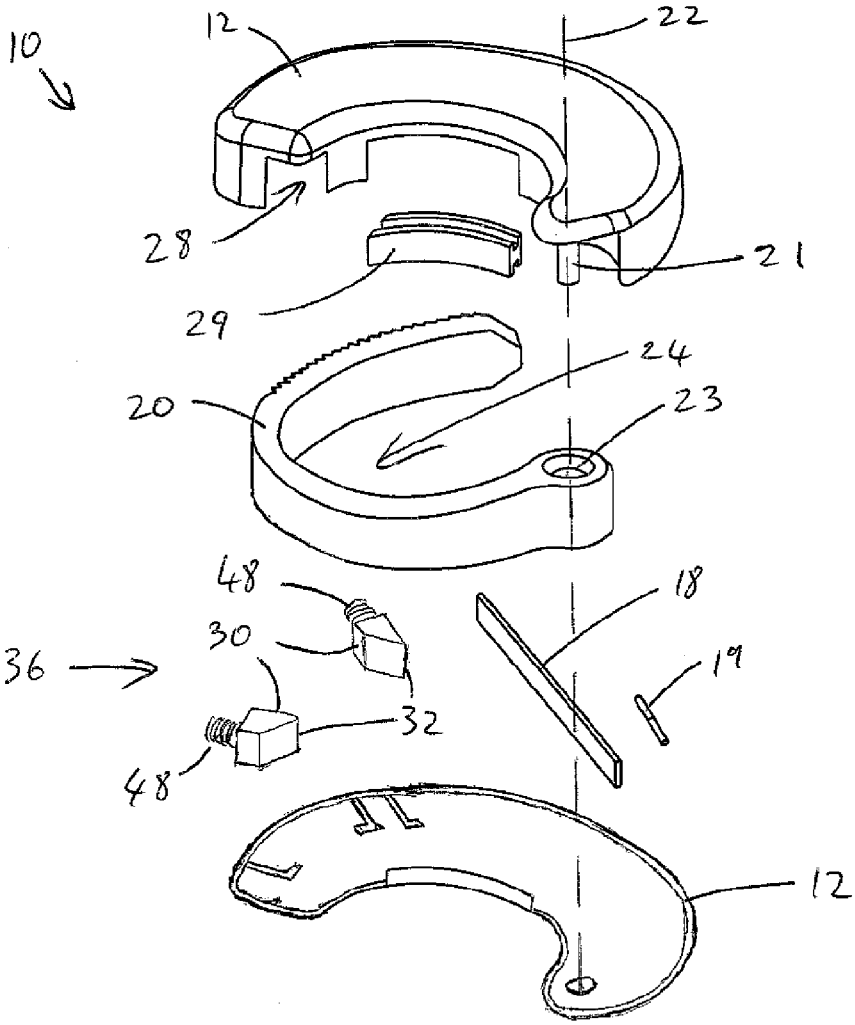
FIG. 2 is an exploded view of the surveillance device of FIG. 1.

The tag 10 includes a sealed, hollow body 12 of a durable plastics material that has a kidney shape, defining a part cylindrical bottle recess 14. The body 12 also defines an inner cavity 16 in which a marker can be fixedly mounted. (In the drawings, reference numeral 16 refers to the entire inside of the body 12, even if it is compartmentalised.) The marker can be an acousto magnetic (AM) marker 18 as shown in FIGS. 2 to 4, preferably with a permanent magnet 19 to provide a magnetic field within which amorphous strips of the marker can resonate. The marker 18 and magnet 19 are retained in spaced apart positions by formations inside the cavity 16 (identified in FIG. 4). However, a conventional AM marker can be used instead, with a ferromagnetic strip attached to the casing of the amorphous strips and such a marker will fit into the space defined by the formations 17 for the marker 18. In other embodiments of the invention, the tag 10 can instead include an electro magnetic (EM) marker 52 as shown in FIG. 5 or a radio frequency (RF) marker such as an RFID marker (not shown). There can be one marker 18,52 in the tag 10, but in preferred embodiments of the present invention, more than one different marker are housed in the cavity 16, to allow the tag 10 to be used as a multiple sensor tag.

The tag 10 includes an elongate, curved latch 20, also of a durable plastics material, that is pivotally attached to the body 12 at its one end, to pivot relative to the body about a pivot axis 22. The pivotal movement is allowed by a spigot formation 21 on one of the halves of the body 12, which forms a pivot axle, extending through an aperture defined in the latch 20. The curved shape of the latch 20 defines a part cylindrical bottle recess 24 on the inside of its curvature. The remote end of the latch 20 that is remote from the pivot axis 22, is curved along an equal radius relative to the pivot axis and this remote end defines a number of locking formations or recesses 26, spaced so closely together that teeth are formed between them. The locking recesses 26 are slanted in a saw-tooth fashion.

Figure 3A:
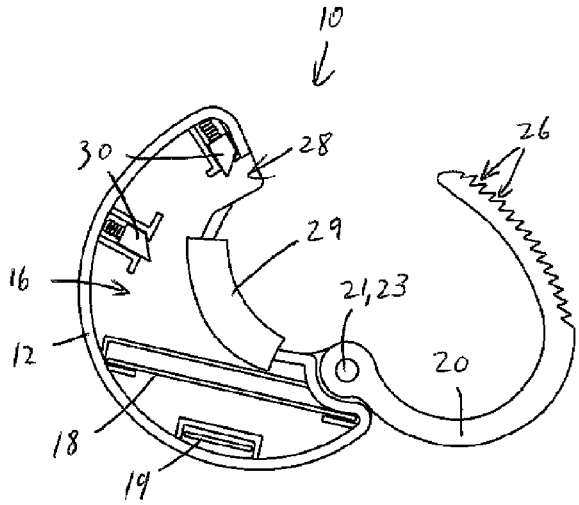
FIGS. 3A to 3D are diagrammatic sectional views of the sequential steps of closing the surveillance device of FIG. 1.
Figure 3B:
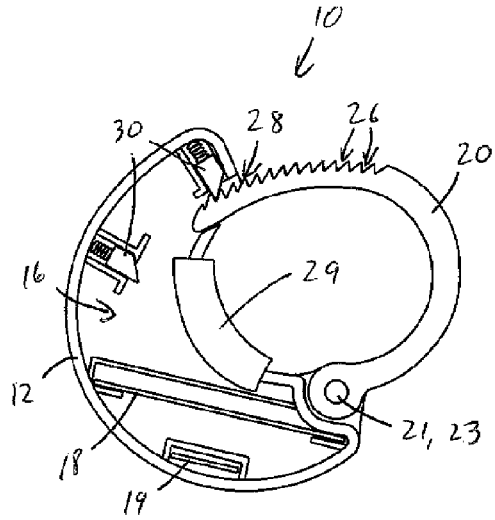
Figure 3C:
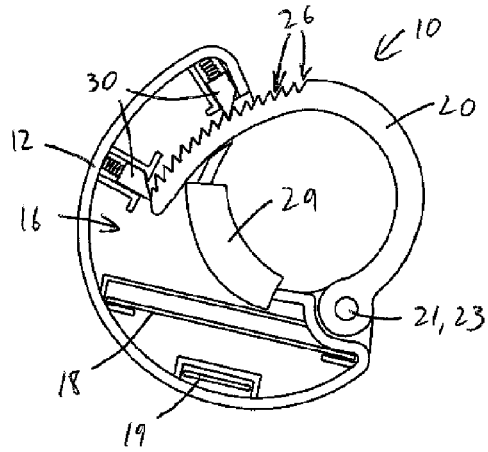
Figure 3D:
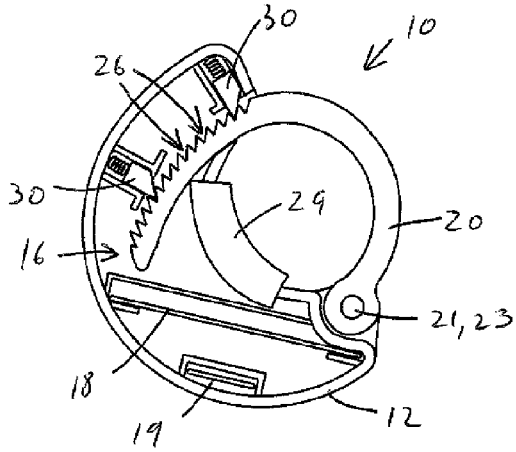
Figure 4:
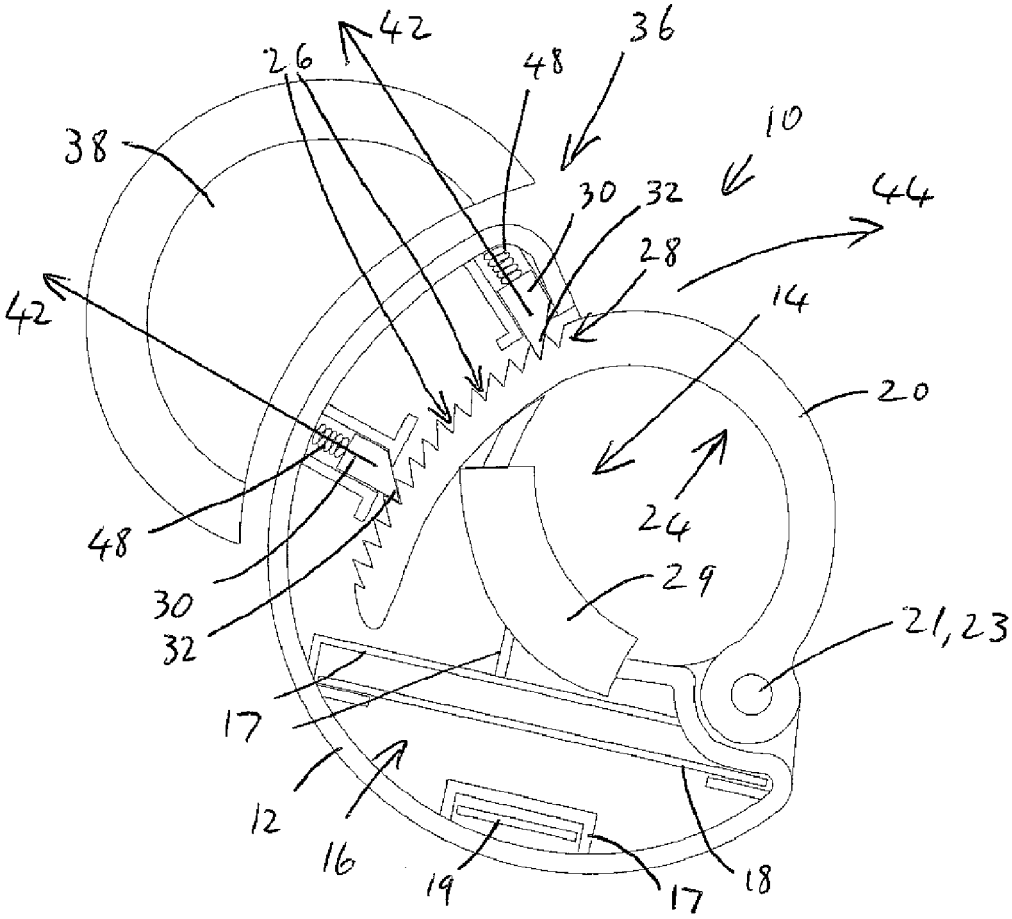
FIG. 4 is a sectional view on larger scale of the surveillance device of FIG. 1 in a closed condition, with a detacher.
Figure 5:
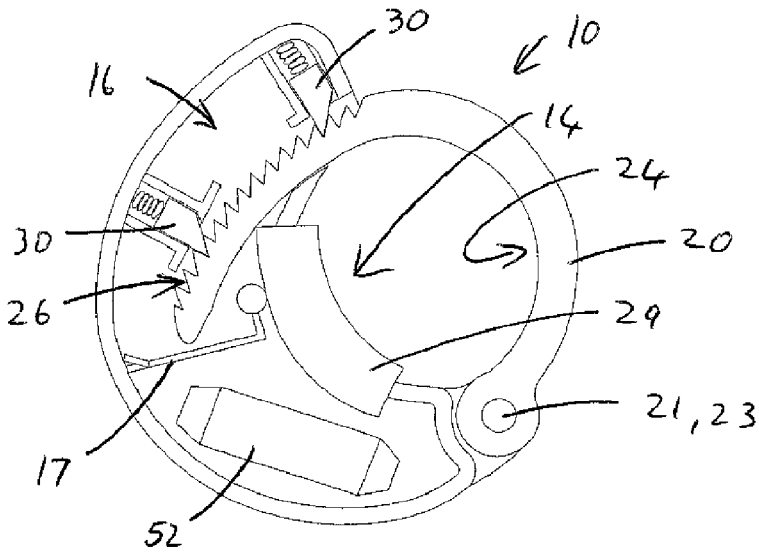
FIG. 5 is a detail sectional view of a surveillance device in accordance with a second embodiment of the present invention.
Figure 8:
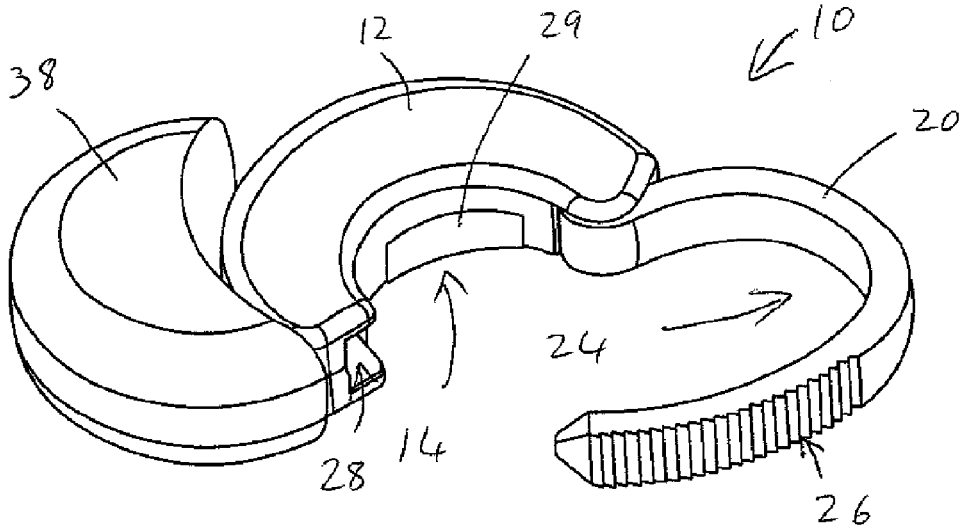
FIG. 8 is a three dimensional view of the surveillance device and detacher of FIG. 4 in an open condition.
Figure 9:
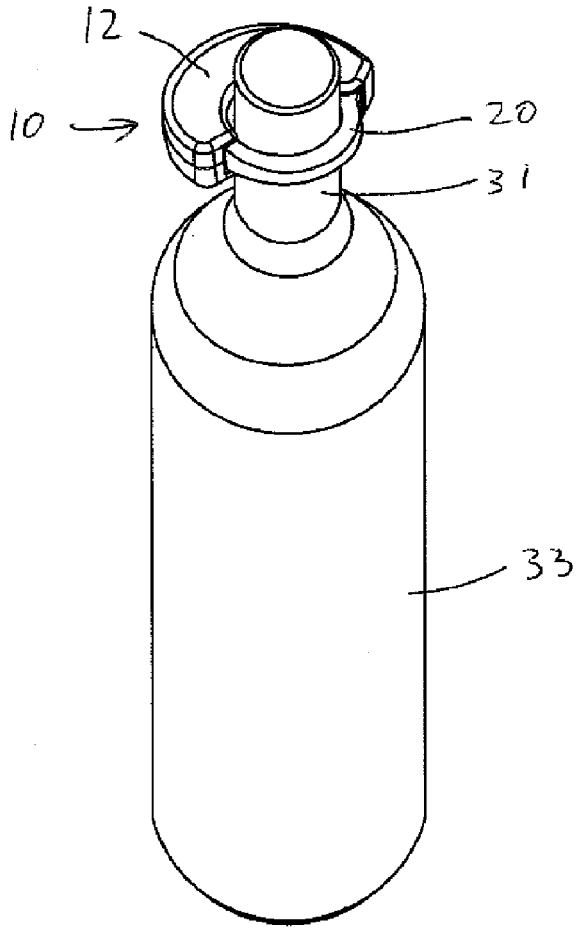
FIG. 9 is a three dimensional view of the surveillance device of FIG. 1 attached to the neck of a bottle.

An aperture 28 is defined in the body 12, through which the remote end of the latch 20 can pass as it pivots about the axis 22, relative to the body, between an open orientation in which the remote end is free, as shown in FIGS. 3B and 8 and a closed orientation in which the remote end of the element extends into the cavity 16 through the aperture 28, as shown in FIGS. 1, 3D, 4, 5 and 9. When the latch 20 is in its closed orientation, the bottle recesses 14 and 24 are combined to form a generally circular or cylindrical aperture that is surrounded entirely by the body 12 and latch. A soft grip pad 29 is provided on the inside of the recess 14 to grip the neck 31 of a bottle 33 and a similar drip pad can also be provided on the inside of the recess 24, if desired.

The tag 10 shown in FIGS. 1 to 5 further includes two detents 30 that are housed in the cavity 16, adjacent the aperture 28. Each detent 30 defines a sharp end or tooth 32 that is slanted with an asymmetrical, saw-tooth profile, similar to the teeth between the locking recesses 26, but opposite in orientation, so that the teeth 32 can engage the locking recesses 26 when the latch 20 is in its closed orientation or is being pivoted towards its closed orientation as shown in FIGS. 3B and 3C.

Figure 7:
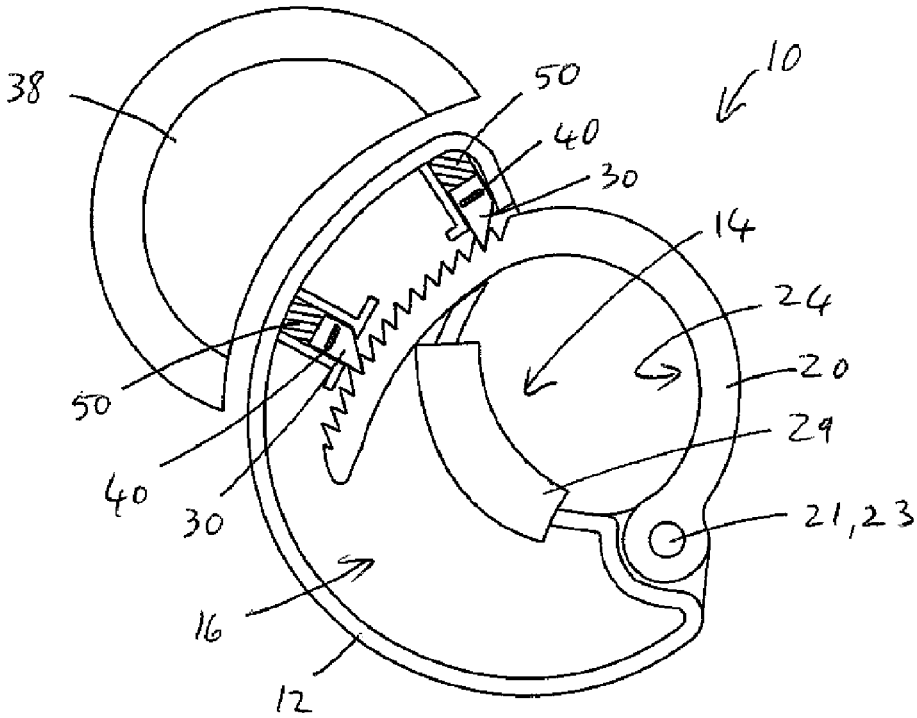
FIG. 7 is a detail sectional view of a surveillance vice in accordance with a fourth embodiment of the present invention.

Each of the detents 33 shown in FIGS. 3, 4 and 5 is made of a magnetically attractable material such as steel and is biased towards the position occupied by the latch 20 when closed, by a bias element in the form of a spring 48, the bias of which presses each detent towards the latch so that its tooth 32 engages the recess 26 that is aligned with it. The detents 30 shown in FIG. 7 are identical in outer shape and function to those shown in FIGS. 3, 4 and 5, but they are made of durable plastic material with magnetic elements 40 inside them so that they are magnetically attractable. The magnetic elements 40 have been inserted from the sides of the detents 30, so that the magnetic forces attracting the elements are not likely to detach them from the detents. Further, in FIG. 7, elastically compressible elestomeric elements 50 are provided to bias the detents 30 towards the latch 20 in much the same way as compression springs.

Figure 6:
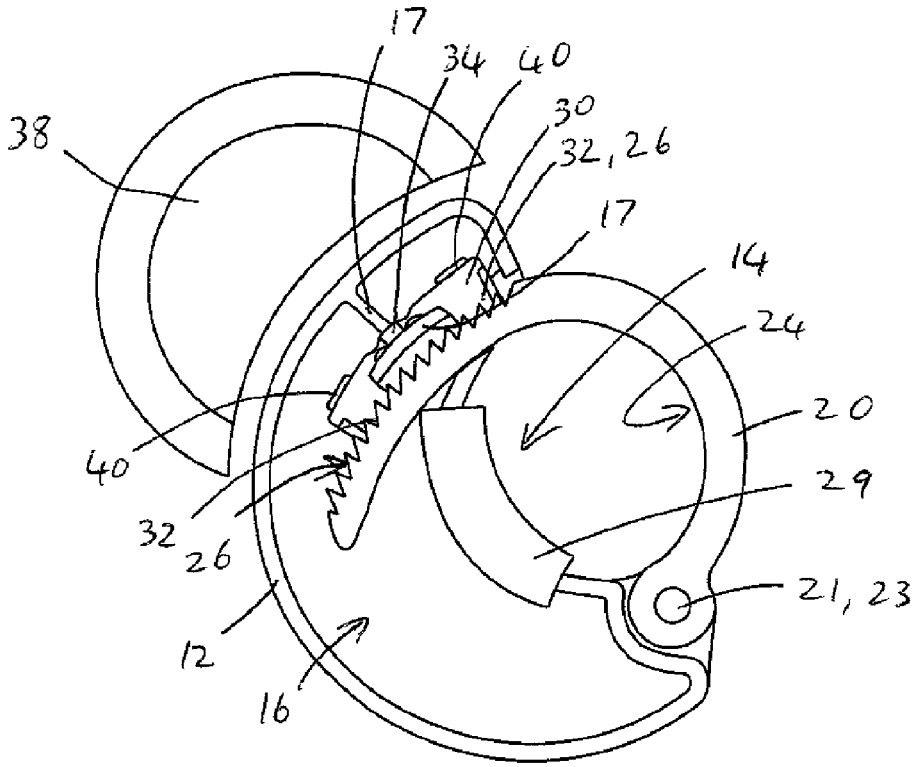
FIG. 6 is a detail sectional view of a surveillance device in accordance with a third embodiment of the present invention.

In the tag 10 shown in FIG. 6, the detent 30 comprises two parts, each with teeth 32 and the bias element is in the form of a resilient length 34 of the detent, extending between the parts and abutting formations 17 on the inside of the cavity 16, to act as a spring when deformed against its resilience. Instead, or in addition, the tag 10 can include a bias element in the form of a spring plate not shown) that can also act as a spring, between the inside of the cavity 16 and the detent 30. The detent 30 is made of a strong, but flexible plastic material and includes magnetically attractable elements 40 that are embedded in each part of the detent.

The tag 10 is intended to be used in conjunction with a detacher that is configured to apply a magnetic force to the tag, when in close proximity to the tag as shown in FIGS. 4, 6, 7 and 8. The tags 10 are configured such that the detents 30 can be magnetically attracted against the biases in the different embodiments of the invention, which thus attracts the detents 30 away from the latch 20, when the magnetic force of the detacher 38 is applied. The detents 30 that are held in engagement with the latch 20 by their bias means 48,50,34, but that can be released by correctly applied magnetic forces, comprise a release mechanism 36 of the tag 10.

In use, the tag 10 is applied to an article in the form of a bottle 33 requiring surveillance. The latch 20 is opened and the neck 31 of the bottle 33 is received between the recesses 14 and 24, before the latch is closed as shown sequentially in FIGS. 3A to 3D, by pivoting the latch so that its remote end passes into the cavity 10 via the aperture 23 until it is closed and the bottle neck is gripped firmly between the grip pad 29 and the latch 20. It should be born in mind that the grip pad 29 is made of a compressible elastomer such as rubber, which can be compressed while the latch 20 is closed, so that the pad 29 grips the bottle neck 31 tightly. While the free end of the latch 20 passes into the cavity 16, the teeth 32 of the detents 30 engage the locking recesses 26 in a ratchet fashion, with the detents and their teeth acting as the pawls. When the latch 20 is closed, the teeth 32 are held in engagement with the recesses 26 by the bias of the springs 48, elastomeric elements 50 or length 34 so that the free end of the latch is held captive within the cavity 16 and the tag 10 cannot be removed from the bottle neck 31.

The tag 10 remains in position on the bottle neck 31 and serves to activate an alarm if the bottle 33 is moved past an appropriate detector that senses the presence of the marker 18,52.

If the bottle 33 may legitimately be moved past the detector, the tag 10 is removed from the bottle by placing the detacher 38 against the body 12 in the correct position and magnetically attracting the detents 30 to withdraw their teeth 32 from engagement with the recesses 26, to allow the latch 20 to be withdrawn in the direction indicated with reference numeral 44 in FIG. 4 and pivoted to its open orientation, so that the tag can be removed. The detacher 38 is shown slightly spaced from the body 12 in the drawings for illustrative purposes, but should preferably be held in abutment with the body.

One of the main reasons why the tag 10 is secure, is that the fact that the detents 30 and their teeth 32 are spaced apart along the curved position of the latch 20 inside the cavity 16. The result is that in order to release the detents 30, magnetic forces need to be applied simultaneously in two spaced apart locations and need to be applied in the directions 42 in which the respective detents can be withdrawn. However, the directions 42 are oriented at an angle relative to each other and this reduces the likelihood that either of the detents 30 can be released by a magnetic force applied in the withdrawal direction 42 of the other detent.

Further, the fact that there are two separate detents 30, each with its own biasing spring 48 or elastomeric element 50, means that both detent need to be released simultaneously before the latch 20 can be withdrawn from the body 12. If the magnetic force on either of the detents 30 is removed before the latch 20 is withdrawn, the bias of that detent will cause it to reengage the latch in its locked orientation. This further improves the security of the tag 10.

Conventional AM markers that provide an electromagnetic field for resonance of amorphous strips by providing a magnetic strip adjacent the casing of the amorphous strips, are prone to being deactivated if exposed to strong magnetic fields which affect the magnetic strength of the magnetic strips and that can demagnetise them. However, in the present invention, the permanent magnet 19 is preferably a rare earth magnet and is not susceptible to deactivation even if exposed to strong magnetic forces. The use of a permanent magnet thus improves the security of the tag 10 and also prevents the tag from being deactivated by the magnetic force of the detacher. The result is that stiff springs 48 can be used that require strong magnetic forces from the detacher to release the detents so that the strength of the magnetic forces required for release of the detents is more than what a shoplifter or thief is likely to be capable of applying.

The invention claimed is:

1. A surveillance device which includes:

a body defining an inner cavity;

at least one marker housed within the cavity; and at least one detent housed within the body;

characterised in that the device includes a latch that is pivotally attached to the body to pivot about a pivot axis, the latch having a curved shape with a remote end of the latch that is remote from the pivot axis, being curved along an equal radius relative to the pivot axis, and said remote end of the latch defines at least one locking formation, the latch being configured to pivot about the pivot axis between a closed orientation in which it's locking formation is inside the body and an open orientation in which the locking formation is free from the body, the detent being configured to engage the locking formation of the latch when the latch is in its closed orientation, and the curved shape of the latch extending around a recess in which a cylindrical object can be received at least in part, when the latch is in its closed orientation.

2. The surveillance device as claimed in claim 1, characterised in that the body defines a recess in which the cylindrical object can be received at least in part, when the latch is in its closed orientation.

3. The surveillance device as claimed in claim 1, characterised in that the locking formation is a locking recess and the detent engages the locking recess by being received in the recess, at least in part.

4. The surveillance device as claimed in claim 3, characterised in that the device includes at least one bias element configured to urge the detent towards the locking recess, when the latch is in its closed orientation.

5. The surveillance device as claimed in claim 4, characterised in that the bias element is a spring.

6. The surveillance device as claimed in claim 4, characterised in that the device includes a release mechanism-PO, configured to withdraw the detent from the locking recess.

7. The surveillance device as claimed in claim 6, characterised in that the detent is configured to be attracted against the bias, by a magnet outside the body.

8. The surveillance device as claimed in claim 1, characterised in that the latch defines a plurality of locking recesses in which the detent is receivable, at least in part.

9. The surveillance device as claimed in claim 8, characterised in that the detent is receivable in the locking recesses in ratchet fashion.

10. The surveillance device as claimed in claim 1, characterised in that the marker is selected from a radio frequency (RF) marker, an acousto magnetic (AM) marker, and an electro magnetic (EM) marker.

11. The surveillance device as claimed in claim 10, characterised in that the device includes a plurality of different markers.

12. The surveillance device as claimed in claim 1, characterised in that the marker is an acousto magnetic (AM) marker and the device includes a permanent magnet configured to provide a magnetic field for operation of the marker.

13. The surveillance device as claimed in claim 1, characterised in that the device includes at least two detents that are spaced apart.

14. The surveillance device as claimed in claim 13, characterised in that the detents are configured to engage locking formations of the latch in respective non-parallel directions.

* * * * *